US009784447B1

(12) United States Patent
Ohunna, II

(10) Patent No.: US 9,784,447 B1
(45) Date of Patent: Oct. 10, 2017

(54) FLEXIBLE UNIVERSAL FLUE PIPE CONNECTOR WITH DAMPER AND SWEEP ACCESS (CONNECTOR WITH DAMPER AND ACCESS)

(71) Applicant: Paul N Ohunna, II, Dayton, OH (US)

(72) Inventor: Paul N Ohunna, II, Dayton, OH (US)

( * ) Notice: Subject to any disclaimer, the term of this patent is extended or adjusted under 35 U.S.C. 154(b) by 0 days.

(21) Appl. No.: 13/728,015

(22) Filed: Dec. 27, 2012

Related U.S. Application Data

(60) Provisional application No. 61/589,813, filed on Jan. 23, 2012.

(51) Int. Cl.

| | |
|---|---|
| ***F24B 1/189*** | (2006.01) |
| ***F23J 11/00*** | (2006.01) |
| ***F23J 3/02*** | (2006.01) |
| *F23J 13/02* | (2006.01) |

(52) U.S. Cl.
CPC ..... *F23J 3/02* (2013.01)

(58) Field of Classification Search
USPC ..... 126/61, 101, 112, 296, 307 R, 312, 126/343.5 R, 502, 515, 523, 545, 536; 431/20, 328, 7
See application file for complete search history.

(56) References Cited

U.S. PATENT DOCUMENTS

| | | | | |
|---|---|---|---|---|
| 54,197 A | | 4/1866 | Nye | |
| 403,468 A | | 5/1889 | Hance | |
| 1,362,660 A | * | 12/1920 | Zave | 15/249.1 |
| 1,528,252 A | | 6/1924 | House | |
| 1,531,223 A | * | 3/1925 | Robinson | 126/116 R |
| 2,392,631 A | | 3/1945 | Berndt | |
| 3,815,523 A | * | 6/1974 | Gibeault | 110/204 |
| 4,048,962 A | * | 9/1977 | Pristelski | 122/20 B |
| 4,251,028 A | * | 2/1981 | Nicolai et al. | 237/8 R |
| 4,294,223 A | * | 10/1981 | Montague | F23L 11/02 126/112 |
| 4,306,491 A | | 12/1981 | Reardon, Jr. | |
| 4,387,700 A | * | 6/1983 | Eggleston | 126/77 |
| 4,424,794 A | | 1/1984 | Page | |
| 4,434,784 A | * | 3/1984 | Van Patten | 126/312 |
| 4,436,080 A | * | 3/1984 | Evans | 126/545 |
| 4,438,705 A | * | 3/1984 | Basic, Sr. | 110/235 |
| 4,476,852 A | * | 10/1984 | Lee et al. | 126/289 |
| 4,490,876 A | * | 1/1985 | Haberl | 15/249.1 |
| 4,672,919 A | * | 6/1987 | Staats | 122/14.22 |

(Continued)

OTHER PUBLICATIONS

Copperfield 2009-2010 Pro Book, The Essential Reference for Chimney and Hearth Professionals, p. 50-53. www.copperfield.com. 304 S. 20th St. Fairfield, IA 52556.

*Primary Examiner* — Steven B McAllister
*Assistant Examiner* — Desmond C Peyton
(74) *Attorney, Agent, or Firm* — Daniel M. Cohn; Howard M. Cohn

(57) ABSTRACT

One embodiment of a pipe universal connector having pluralities of conduits (25, 33, 35) which communicates with other pipes (63), appliance (67) and access bin (39). At least one or more conduits consist of flexible material that can instantly adjust-on-demand to desired angle, offset, turns and positions, making this connector able to replace a T-pipe, Y-pipe and more. In addition, damper (27) and gutter (53) inhabits the intersection (59) to control access to energy and environmental modules, debris, draft and downdraft movement.

6 Claims, 6 Drawing Sheets

(56) References Cited

U.S. PATENT DOCUMENTS

| | | | | | |
|---|---|---|---|---|---|
| 4,683,623 | A | * | 8/1987 | Cannata | 126/523 |
| 4,807,320 | A | * | 2/1989 | Labrecque | 15/249.1 |
| 4,846,147 | A | | 7/1989 | Townsend et al. | |
| 4,858,517 | A | | 8/1989 | Coker | |
| 4,964,396 | A | * | 10/1990 | Crum | 126/508 |
| 5,393,260 | A | | 2/1995 | Barth | |
| 5,494,319 | A | | 2/1996 | Thomas | |
| 5,842,246 | A | * | 12/1998 | Doyle | 15/104.068 |
| 6,588,802 | B2 | | 7/2003 | Schukal | |
| 7,798,891 | B2 | * | 9/2010 | Stubbert et al. | 454/44 |

* cited by examiner

FLEXIBLE UNIVERSAL FLUE PIPE CONNECTOR WITH DAMPER AND SWEEP ACCESS (CONNECTOR WITH DAMPER AND ACCESS)

CROSS REFERENCES TO RELATED APPLICATIONS

This application claims priority from and benefit of provisional patent application Ser. No. 61/589,813 titled "Flexible Universal Flue Pipe Connector with Damper and Sweep Access" filed Jan. 23, 2012, which is hereby incorporated here by reference in its entirety.

FEDERALLY SPONSORED RESEARCH

None

SEQUENCE LISTING

None

BACKGROUND

This relates generally to flexible connector for piping and particularly pertains to flexible connector functioning as universal connector with conduit damper, gutter, sweep access and bin to improve access and maintenance of a combustion flue pipe, energy and environmental accessories.

The chimney industry uses various types of flue pipe for connections. There are T-pipes, Y-pipes and L pipes. Many are not made of the flexible pipes. To get some flexibility, a combination of two or more pipes (likely L-pipe and T-Pipe) may be used to yield some flexibility in direction. However, such flexibility is predetermined by the fixed angles of the particular L- or T-pipe acquired. In other words, angles and direction cannot be made on-demand and on site.

The L-pipes have the primary function of changing the direction of the flue pipe. The angles of direction change are fixed and most are 90 degrees. T-pipes have the three functions. One function is to split a pipe in two directions. A second role is changing direction like L-pipes. The third function is the result of a split and change in direction where one end is capped and used to provide maintenance access clean-out into the flue pipe. Access clean-out caps created in this form are usually remotely located inside a brick chimney wall or behind the appliance such as wood stove or both. The remote location of such clean-out caps requires dismantling the pipe to access and clean-out the creosote and condensate that settled in it. Even when the tee cap is cleaned out, it is done infrequently due to the daunting task. The daunting tasks warrant the abandonment of the clean-out cap debris content for years. An abandoned clean-out cap collects condensate, creosote and dissolved acidic gases which form corrosive and odorous mixture. Depending on the material of the cap and T-pipe resistance to corrosion, their life span may be reduced due to the corrosion.

Several energy recovery and environmental flue gas treatment instruments has been and are being introduced in the field of fuel combustion. Many of these accessories have not functioned well partly due to design and partly due to lack of easy means of maintenance. For an example, a heat recovery apparatus inserted in a flue pipe will condense creosote on the exchanger surface. The condensed creosote inhibits the efficiency characteristics of the surface to continue absorbing heat energy. Furthermore, the dimension of the flue pipe opening becomes smaller due to the accumulation of the solid creosote in its space. When the dimension of the pipe is smaller, the draft is reduced. Another serious safety effect is the increased risk of chimney fire due to accumulated creosote. A traditionally used fireplace chimney may be swept yearly but a flue stack with environmental or creosote condensing apparatus would need improved access for more frequent servicing, efficient performance and safety.

T-pipes and their clean-out are used outside a brick chimney confinement such as double and triple wall flue pipes in the exterior of a building. In such instance, the appliance connects to the right angled, horizontal conduit of the T-pipe. The right angle makes the flue gas to flow horizontally which is not efficient and the vertical access conduit of the T-pipe points inaccessibly to the ground. Damper has a secondary function to lockout the downdraft and odor during downtime period. The lockout function is missing in a flue pipe damper. Many flue pipes have inadequate damper or have no dampers at all. Dampers that have smaller radius than the flue pipe can passively regulate draft but cannot lockout downdraft when flue pipe is not in use.

In essence, the T-pipes are mainly for split connection. They do not easily serve as a clean-out cap for chimney flue pipes. There is therefore the need for a different kind of T-pipe that offers flexible direction, easier access for clean-out, maintenance, safety, prevention of odor and downdraft.

PRIOR ART

The following are some prior art that may be relevant:

U.S. Patent Documents

| | | | |
|---|---|---|---|
| 54,197 | April 1866 | Nye | |
| 403,468 | May 1889 | Hance | |
| 861,409 | July 1907 | Wagner | |
| 1,427,107 | August 1922 | Kaplan | |
| 1,528,252 | June 1924 | House | |
| 2,035,974 | March 1936 | McWilliams | 236/93 |
| 2,392,631 | March 1945 | Berndt | 72/94 |
| 4,099,747 | July 1978 | Meserole | 285/174 |
| 4,306,491 | December 1981 | Reardon, Jr. | 98/60 |
| 4,329,973 | May 1982 | Scullin, Jr. | 126/123 |
| 4,424,794 | January 1984 | Page | 126/123 |
| 4,846,147 | July 1989 | Townsend et al | 126/307 |
| 4,858,517 | August 1989 | Coker | 98/1 |
| 4,875,463 | October 1989 | Washington | 126/80 |
| 5,133,579 | July 1992 | Anderson et al | 285/226 |
| 5,158,328 | October 1992 | Anderson et al | 285/168 |
| 5,199,190 | April 1993 | Mayer et al | 34/235 |
| 5,390,967 | February 1995 | Gooderham et al | 285/177 |
| 5,393,260 | February 1995 | Berth | 454/44 |
| 5,494,319 | February 1996 | Thomas | 285/55 |
| 5,741,029 | April 1998 | Wilson | 285/114 |
| 6,234,163 B1 | May 2001 | Garrod | 126/80 |
| 6,588,802 B2 | July 2003 | Schukal | 285/133 |
| 7,798,891 B2 | September 2010 | Stubbert et al | 454/44 |

U.S. patent application Publications

| | | | |
|---|---|---|---|
| 2002/0,149,201 A1 | October 2002 | Pichotta | 285/192 |
| 2004/0,160,057 A1 | August 2004 | Barnoff | 285/133.11 |
| 2006/0,249,142 A1 | November 2006 | Bibaud et al | 126/312 |
| 2007/0,176,416 A1 | August 2007 | Swank | 285/174 |
| 2007/0,221,195 A1 | September 2007 | Bibaud | 126/80 |
| 2008/0,196,161 A1 | August 2008 | Ball | 4/680 |
| 2010/0,108,144 A1 | May 2010 | Yates et al | 137/1 |
| 2010/0,170,589 A1 | July 2010 | Boettner et al | 138/119 |
| 2011/0,068,569 A1 | March 2011 | Boettner | 285/133 |

NON-PATENT LITERATURE DOCUMENTS 2010-2011 Catalog for Chimney Professionals and Hearth Retailers, Copperfield Chimney Supply, 304 S. 20th St. Fairfield, Iowa 52556, www.copperfield.com 2011-2012 Chimney & Venting Catalog, Olympia Chimney Supply company, www.olympiachimney.com Scullin Jr., in U.S. Pat. No. 4,329,973 illustrated the use of elbow (L-) flue pipe connector, connecting wood stove to board and plate having central opening in the chimney. The elbow must be pre-aligned in height and angle to fit the stove placement. Townsend et al, in U.S. Pat. No. 4,846,147 and Bert, in U.S. Pat. No. 5,393,260 used flexible metal pipe to connect to an insert. In all three cases, the stove insert connection has to be disassembled to clean creosote in the flue pipe. When disconnected, a high vacuum is needed to keep loosened dust particles from living space and personnel. The alternative to disassembling the setup is to insert sweep brush through the chimney top. When the sweep is performed from the chimney top, all of the particulates fall into the smoke shelf of the stove where a delicate catalytic combustor would be housed. In both sweep approaches, disassembling and reassembling the connectors or smoke shelf will be required.

House, in U.S. Pat. No. 1,528,252, Wagner in U.S. Pat. No. 861,409, Page in U.S. Pat. No. 4,424,794, Stubbert et al, in U.S. Pat. No. 7,798,891 Reardon Jr. in U.S. Pat. No. 4,306,491, and Schukal in U.S. Pat. No. 6,588,802 B2 disclosed various embodiments of T connector for connecting an appliance to a flue pipe. All of these tee connectors have a vertical main pipe and a horizontal branch pipe which connects to the appliance. The top of the main pipe is connected to an extension which terminates in a vent cap on top of a chimney. The bottom of the main pipe is connected to a clean-out cap. House incorporated a tubular sleeve insert that is rotatable to prevent swept creosote particle from entering the stove. Wagner used a strap and notches to make the branch pipe have some adjustability. Reardon Jr. and Page shows the T-pipe inside the fireplace and behind the appliance. Schukal shows the T behind a brick enclosure. All of these T-pipe connectors are not very flexible and easily accessible. When caps are opened and cleaning is being performed, fine particles get into human space due to lack of containment.

Regarding the damper, Nye in U.S. Pat. No. 54,197 and McWilliams in U.S. Pat. No. 2,035,974 disclosed different forms of traditional dampers. In these disclosures, the dampers have smaller diameters than the inner diameter of the flue pipe and are located at the middle stream of the host flue pipe. For solid fuel flue, the midstream location of the dampers obstructs sweeping thru with a creosote cleaning brush. Also, the smaller diameter of the damper is not able to stop creosote particles from falling into the appliance smoke shelf.

Known flue T, L pipes and other connectors suffer from one or more of the following disadvantages:

(a) Need to preposition and align the connecting members in height and angle to fit.

(b) Need to disassemble the connections in order to perform maintenance cleaning. There is high level of sophistication, training time and tool required to perform maintenance. The degree of difficulty does not leave room for routine or do-it-yourself maintenance.

(c) Alternately, cleaning from the top of chimney requires climbing, disassembling of the smoke shelf and potential damage of catalytic combustor.

(d) The particulate matters generated during cleaning are not easily contained from personnel and living space.

In conclusion, there is a need for T-pipe and L-pipe connectors that have convenient remote access, flexibility, and protective lockout for use in solid fuel appliances and flue pipe connection.

SUMMARY

This invention relates generally to piping and particularly pertains to flexible connector functioning as universal connector having damper, gutter, sweep access and bin to improve frequency of maintenance including any downstream modules. The invention provides a new generation of connector with better degree of flexibility, access and protection. In the case of a wood stove, for example, flexibility of connector conduit would provide flexibility in appliance location. As could be seen in some prior art, location of appliance could not deviate up, down, left or right. The sweep access provided by the present invention would make maintenance easy and routine. A sweep brush would be inserted and guided in the conduit pipes while an integrated bin provides loose material containment. A closeout damper plate and a trough will protect catalytic combustor and living space from particulates, downdraft and condensate. The damper allows for sweep-thru access and prevents and diverts particles from entering the smoke shelf of appliances.

DRAWINGS—FIGURES

FIG 1. is a perspective view of the universal connector, showing a pass thru sweep brush and a cutout of intersection inner structure.

DRAWINGS—REFERENCE NUMERALS

| | | | | | |
|---|---|---|---|---|---|
| 21 | damper control | 23 | latch | 25 | flexible conduit |
| 27 | damper | 29 | female connection end | 31 | strap |
| 33 | secondary flexible conduit | 35 | main conduit | 35b | outlet connection |
| 37 | hook | 39 | bin | 41 | brush inlet cover |
| 43 | brush inlet | 45 | spring | 47 | brush cover controller |
| 49 | particle outlet | 51a | secondary male connection end | | |
| 51b | male connection end | 53 | gutter | 55 | brush |
| 57 | brush rod | 59 | Intersection | 61 | brick chimney wall |

-continued

| | | | | | |
|---|---|---|---|---|---|
| 63 | flue pipe | 67 | appliance | 68 | appliance male connection |
| 69 | creosote particles | 71 | attachment seams | | |

DETAILED DESCRIPTION OF THE EMBODIMENTS

Figures 3, 4:
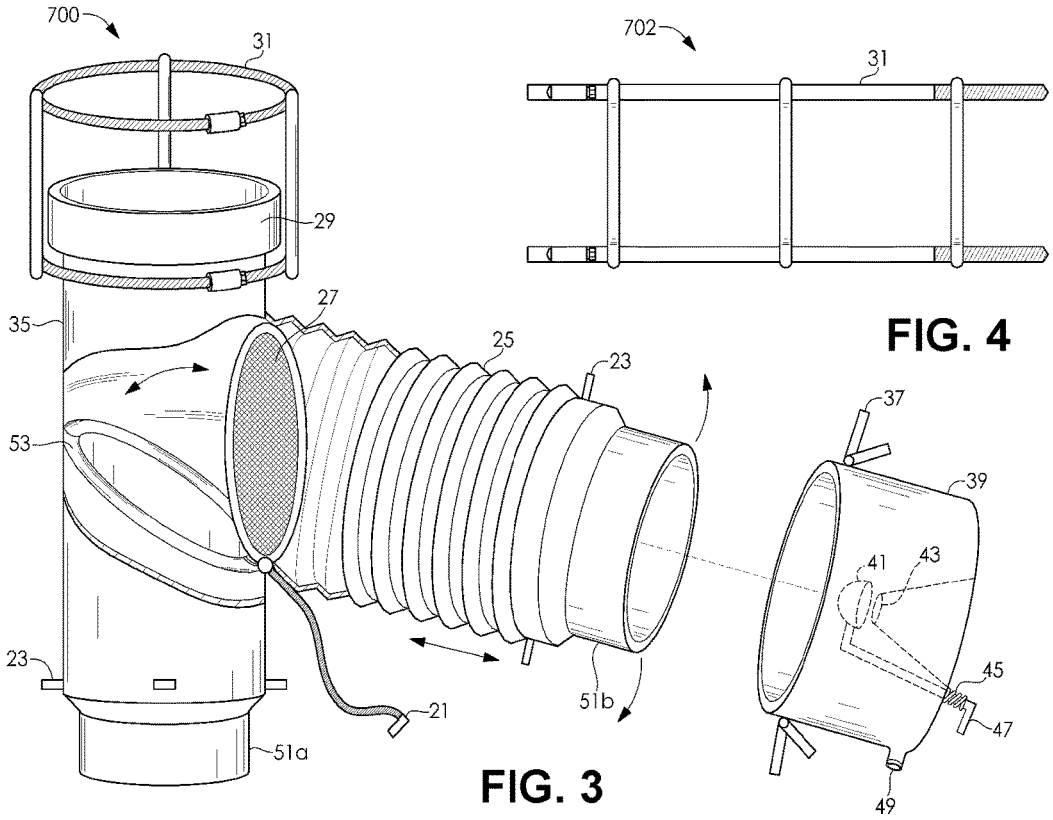
FIG. 3 is a perspective view of a universal connector having one flexible member presented in accordance with this disclosure, showing a cutout of intersection and inner structure damper and trough.
FIG. 4 is a perspective view of strap for connecting a universal connector to components of the flue system.

Construction:—FIGS. 3, 4

One embodiment of the universal connector is illustrated in FIG. 3 (side view) and FIG. 4 (static view). The connector has a main connection 35 consisting of cylindrical material suitable for the particular application. For high temperature combustion, such as wood stove and coal, refractive material such as Titanium alloy, 0.005" or better thickness, stainless steel, 0.015" or better thickness are used. The main connection 35 is adopted for connecting to a pipe downstream with a female end 29 in accordance with American Chimney Safety Institute and likewise a male end 51*a* for connecting upstream to a flue source. In one embodiment, a strap 31 from FIG. 4 is used for primary or additional connection with any flue source or pipe. The ends of the main connection 35 are provided with anchor latches 23, used for some hook types of connection.

Along the main connection 35 cylinder and between male end 51*a* and the female end 29 is located an oblong gutter 53 attached to the inner circumference and a circular opening on which branch flexible pipe 25 is connected. The gutter 53 consists of same material as the main connection 35 and opens its outlet into the bottom of the branch flexible pipe 25. On top and across the opening of the gutter is attached a damper 27 with its damper control 21 to elevate or lower the damper over the gutter 53. The branch pipe 25 is connected to the main connection 35 circular opening by any means known in the art including welding. The branch flexible pipe 25 consists of corrugated cylinder made of refractive such as Titanium alloy, 0.005" or better thickness, stainless steel, 0.015" or better thickness material. The branch flexible pipe terminated in a male end 51*b* and has the optional latch 23. A removable bin 39 is designed for connecting to the mail ends 51*a* or 51*b* by hook 37 means on the latch 23 means for attachment. A bin 39 consisting of same material as the main connection 35 and embodies a brush inlet 43 at the bottom. The brush inlet 43 is provided with a brush inlet cover 41. The brush inlet cover 41 is controlled by a brush cover controller 47 with a spring 45 to provide a stability control tension.

Figure 2:
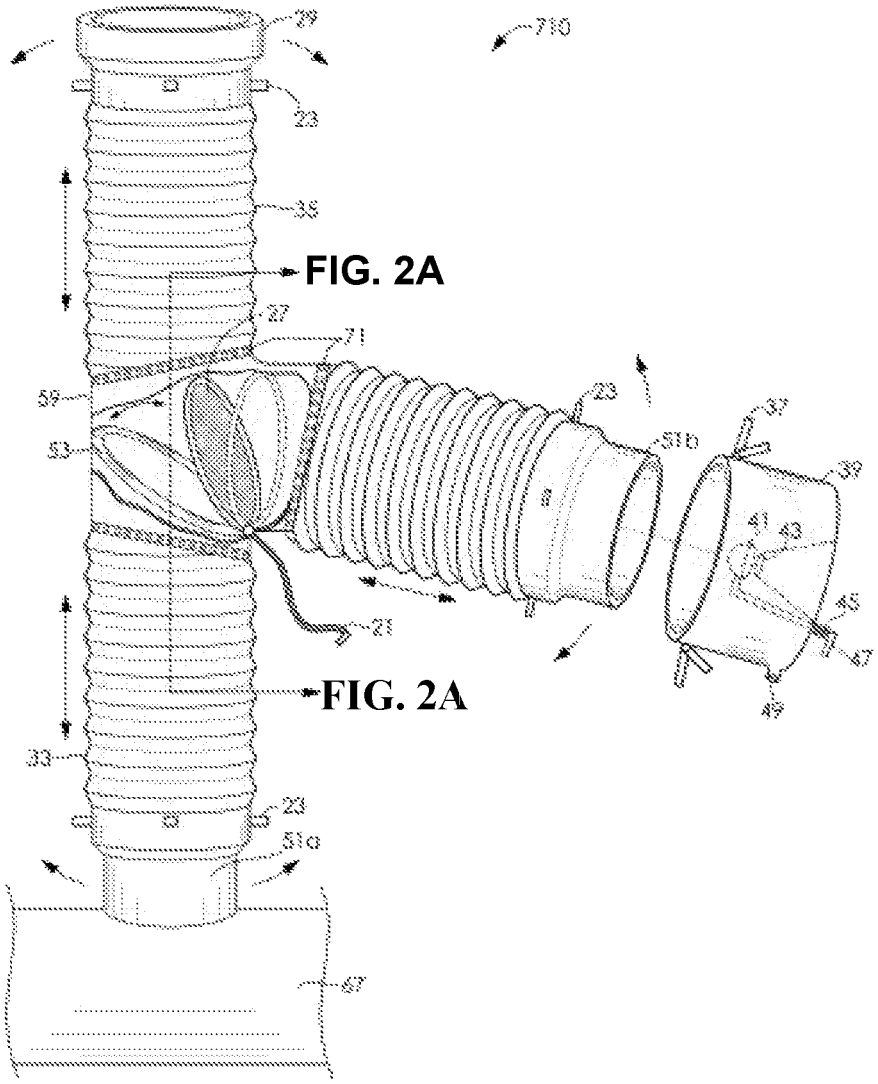
FIG. 2 is a perspective view of the universal connector having three flexible members presented, showing a cutout of intersection and inner structure damper and trough.
Figure 2A:
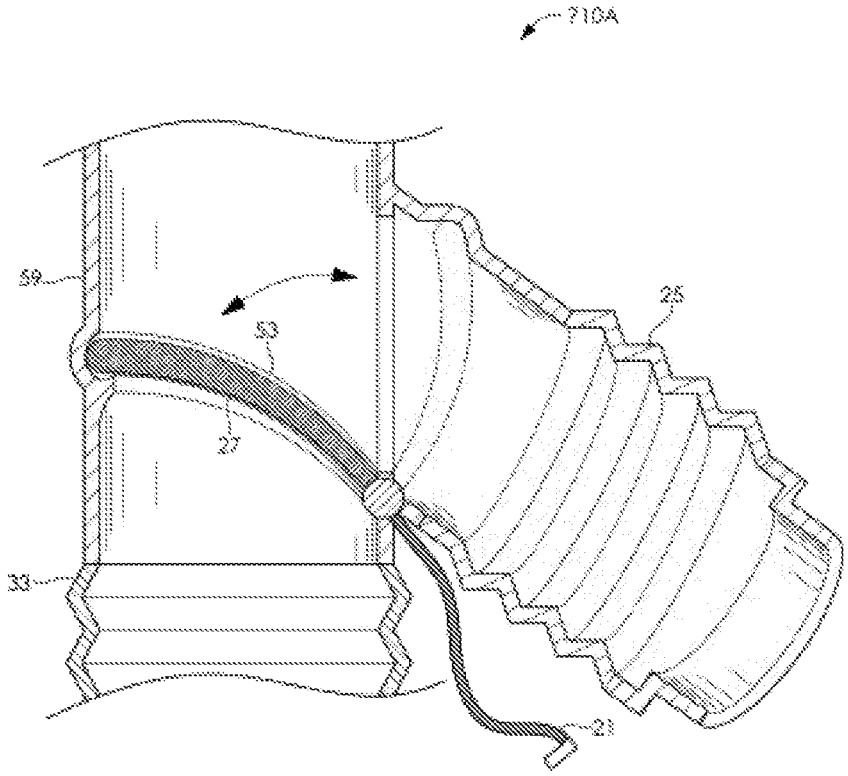
FIG. 2A is a cross-sectional view of the central portion of FIG. 2.showing a trough, and the damper.

FIGS. 2, 2A—Alternate Embodiments

Figure 1:
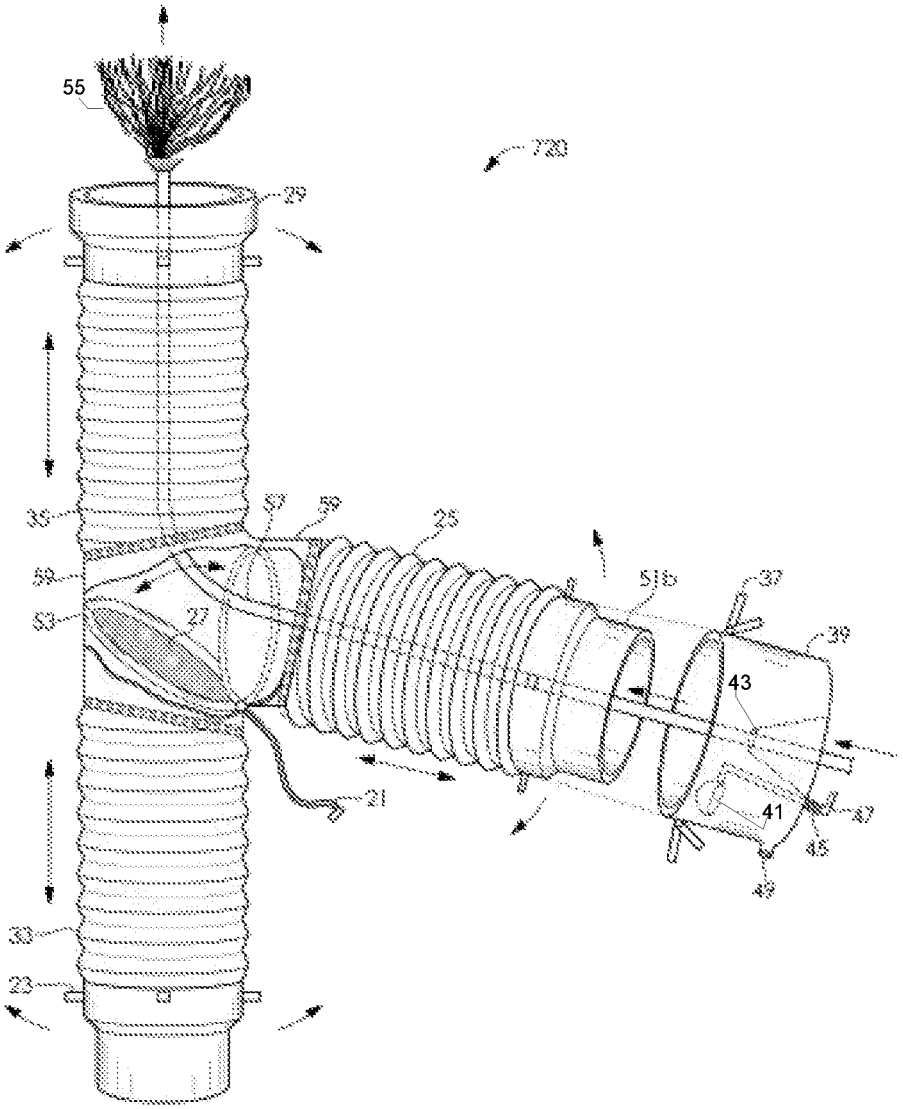

In achieving a multiple flexible branch conduits 25, 33 and 35 in FIG. 1, there are several attachment options, like a connecting intersection 59. A connecting intersection 59 for the multiple conduits consists of same refractive material that is pattern stamped and welded along the seams to form openings for the desired number of branch conduits. The formed openings of the connecting intersection 59 are flared, bent outwards and backwards to form an outward grove. The flexible pipe connecting branch conduits end are flared, bent inward and backwards to form an inward grove. The outward grove of the connecting intersection 59 opening and the inward grove of the branch conduit pipe are hooked and crimped or welded to form attachment seams connection 71.

In another alternate attachment option for connecting intersection 59 is pattern stamped to include desired number female and female ends. This alternate embodiment allows the flexible branch conduits 25, 33, and 35 to have a male 51*a* and female 29 on opposite ends or male-male or female-female ends. Under this embodiment, user may order components and design their desired universal connectors Operation:—FIGS. 1, 5, 6

Using the universal connector to connect pipe to pipe or pipe to appliance is similar but relatively easier than using a T-, L-pipes and other forms of connectors currently available. The universal connector could be used to replace existing connections that does not have a damper and easy access functionality that comes with the present invention.

To install universal connector 710 in place of existing T-pipe, L-pipe and regular flue pipe connection, a section of the existing pipe or connection has to be removed. Prior to removing the section, the correct diameter of the universal connector would be ordered from the manufacturer or distributor by a chimney professional such as American Chimney Safety Certified Technician. The type of universal connector embodiment—one flexible conduit 700 or pluralities of flexible conduit 710 has to be determined. The appropriate or suitable fastener options have to be determined. Adequate fasteners for the determined installation method have to be acquired. The universal connector offers several fastening methods such as clamps 33 in FIG. 4 hooks 37 and latch 23, riveting and self-drill screws.

After removing an existing T, L or flue pipe, appropriate length has to be removed to make room for the universal connector 710. Once again, the stretchable and contractible features of the universal connector conduits make it possible to exempt precision is the length that would be cut. In other words, for universal connector 710 with all-flexible connections 25, 33, and 35, the room created, need not be exact as the stretching and contracting is an in-built character. The universal connector 710 is put in place and fastened. Where installation placement is angular or horizontal, it is preferred that the connection 25, leading to the bin 39 be at relative lower half of the horizontal plane to allow flow of condensate and loose material to the bin 39. On the other hand, when the conduit 25, leading to the bin 39 is on the top half of the horizontal plane, the steepness angle must not exceed the effect of the oblong angle of the gutter 53 to channel material and condensate towards the bin 39 conduit 25.

Upon complete installation, outside air downdraft are prevented by closing conduit 33 leading to the appliance 67 and attaching the bin 39 to the male connection end 51*b*. The conduit 33 is closed by turning the damper control 21 counter-clockwise until the attached damper 27 covers over the gutter 53. When appliance is to be used, the damper 27 is opened to desired level of draft by turning the draft control 21 clockwise.

Prior to reuse of an appliance 67, the flue may need cleaning. Directing attention to FIG. 4, a brush inlet 43 is opened by pushing-in a brush cover controller 47 against a return spring 45 and rotates it until brush inlet cover 41 is clear-out of the brush inlet 43. A sweep brush 55 such as a sweeping whip or spin brush attached to a sweep rod 57 such as ButtonLok™ brand is inserted thru a brush inlet 43 towards the intersection 59. The damper controller 21 is used to close the damper 27, by turning until it covers over the oblique angle of the gutter 53 surface. The Damper 27 closes-out the appliance conduit 33 from debris and directs the brush and rod downstream of the flue pipe and debris down the bin 39.

Figure 5:
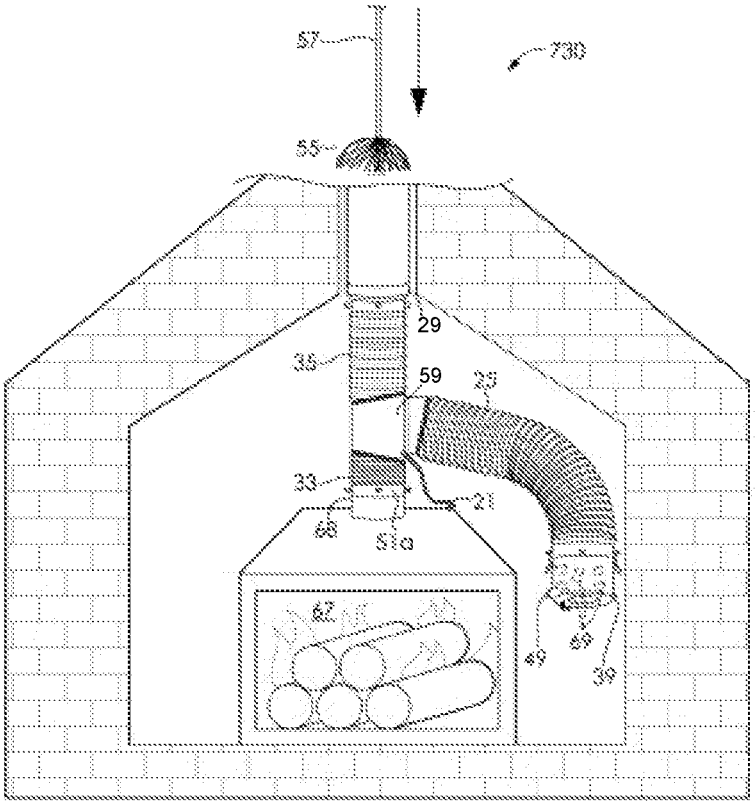
FIG. 5 is a perspective view of a universal connector having application in a fireplace insert combustion flue system.

Directing attention to FIG. 5, the connector is used in a fireplace insert stove 67 connection to a chimney flue pipe. The embodiment of compressibility of the conduits is illustrated in the conduit 33 where lack of space and need to shorten the connection was me the bin 39 is in place while the appliance in use. When the appliance is not in use, the damper 27 is closed; sweep brush 55 and its rod 57 can be inserted into the flue pipe from the top, as an alternative process. The closed damper will perform the role of protecting the appliance and directing the sweep brush 55, rod 57 and debris 69 towards the bin 39. After the sweep process, the bin 39 may would be detached, content discarded and bin 39 is reattached and the system is ready for use. Where available and desired, a vacuum cleaner may be attached to the bin's particle outlet 47 by removing its cap.

Figure 6:
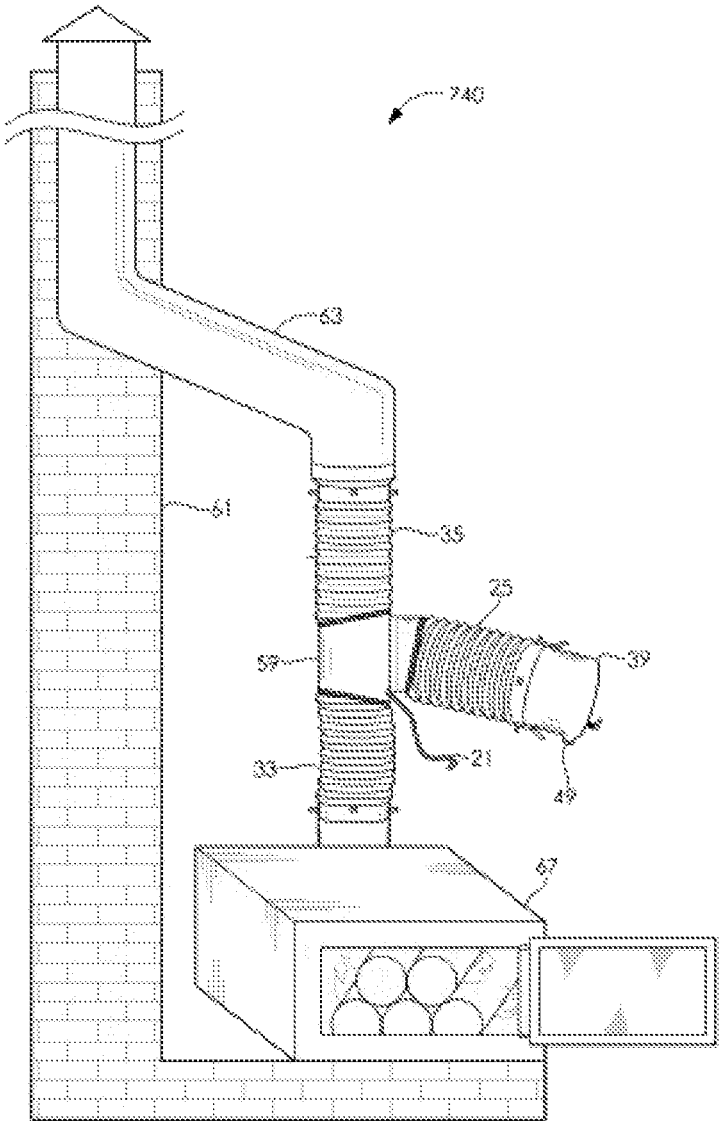
FIG. 6 is a perspective view of a universal connector having application in a stand-alone combustion flue system.

Directing attention to FIG. 6, the connector is used in a standalone stove 67 connecting to a flue pipe 63 exiting through a chimney wall 61. Notable in this application of the universal connector 710 is the offset in alignment between the appliance 67 location and the vertical position of the pipe 63. The offset is well compensated but the flexible conduit 33.

In another embodiment, the universal connector 710 is used in a hot water gas boiler vent to draw ambient air to mix and cool boiler 67 hot flue to make the flue temperature cooler for plastic vent pipe that cannot handle hot flue temperature. The damper 27 is used to partition between the hot flue gas and the ambient intake through the conduit 25. In such instant, the bin 39 is not attached or when attached, the inlet cover 41 is left open for ambient air to enter.

Advantages

The present universal connector disclosure offers all and more of the following advantages:

1. Conduit
   - (a) Provide easier access means to sweep the creosote in the flue pipe, access and maintain energy recovery and environmental flue modules connected downstream.
   - (b) Provide alternative cleaning from the top of chimney, making disassembling of the appliance smokes shelf and potential damage of catalytic combustor becomes a thing of the past.
   - (c) No need to disassemble the connections in other to perform maintenance cleaning. It cuts down on high level of sophistication, training, time and tool required to perform maintenance. It becomes ideal for a routine or do-it-yourself maintenance.
   - (d) Provide a connector with at least three conduit outlets members in which at least one connecting member is a flexible conduit. In an application where all connecting outlet members are flexible conduits, the connector possesses the overall flexibility to replace a T, L, Y or other forms of connectors. Provide a T and Y flex pipe type function with flexible dimensional adjustment and varying angle.
   - (e) Provide elongation and contraction of extensions to the stack, stove and bin connections Provide the ability to position the bin for easy access without disconnection and removal of the stove. Most common sweep rods such as ButtonLok™ rods will require great energy to negotiate acute angles in the vent pipe system. The present invention provides the on-demand flexible conduit angle.
   - (f) Where a split is needed, the sweep access conduit will be converted to any angle on-demand. It will accommodate human measurement errors, easier adjustable installation, and future redirection changes. There is no need to preposition and align the connecting members in height and angle prior to connection.
2. Damper
   - (a) Provide damper means to close out down draft and chimney odor from entering living space during idle period. Closes the entrance to the conduit leading to a appliance and direct debris to the conduit leading to the containment bin. There is effective odor and downdraft control stop during downtime. Provide a plate that is mounted at the corner of intersecting members and functions as a lockout of downdraft, odor and loose particle from entering living space. In addition, the plate functions as a damper for appliances and flue pipes that has no existing draft control.
   - (b) At an intersection, the plate directs the sweeping brush and rod to the conduit downstream and debris to the bin.
   - (c) Provide damper to close out downdraft and prevent flue odor from entering living space during the downdraft. Prevent swept particles such as creosote from entering the stove. This damper plays the extra role of closing out the outside air, downdraft and odor from entering living space through the chimney.
   - (d) A damper with all the ability of draft control and into the abilities to control downdraft without residence in the flue path or obstruction of sweep through operation.
3. Gutter
   - (a) Provide means to direct and prevent swept particulate creosote from entering the smoke shelf of a connected appliance. In current status quo, if a flue pipe creosote is swept through an appliance whose smoke shelf has been removed, without a high capacity vacuum system, the particulate creosote will enter the and living. This invention present a better means to bypass and hence protect an appliance and living space.
   - (b) Provide gutter means to direct loose particles and condensate to flow away from alley to a containment mean.
   - (c) Provide trough to direct flow of condensed fluid and fallen materials into the bin containment.
4. Bin
   - (a) The particulate matter generated during cleaning is easily contained from personnel and living space in the enclosure of a bin.
   - (b) Provide a bin that contains loose particles from entering the living space during maintenance cleaning.
   - (c) Provide means for connecting and sweeping access for two combustion sources using one flue pipe. Provide a parallel or serial union of two or more stoves alternately sharing one stack pipe.
   - (d) Provide means for union of two or more stoves alternating use of a flue stack. Such alternation can be made a simultaneous use where the there is a positive air displacement means in the flue pipe.

Conclusion, Ramification, and Scope

Accordingly, it can be seen by the reader that this universal connector with its many embodiments can replace any T-, Y-, and L-pipe connector and have convenient remote access, flexibility, and protective lockout for use in combustion appliances and flue pipe connection. It can be seen by the reader that the universal connector, in all its embodiments can connect an appliance more easily to a flue pipe, provide quick access to maintenance, and protect appliance and living space.

Although the drawings and detailed descriptions above contain much specificity, those should not be construed as limiting the scope of the embodiments but as merely providing illustration of some of embodiments. For example, the use of the universal connector in the hot water boiler could be applied to the use in a dryer vent with some modifications of material. The embodiments are capable of numerous modifications, rearrangements, and substitutions of parts and elements without departing from the scope of the invention. Thus the scope of the embodiment should be determined by the appended claims and the legal equivalents, rather than the examples given.

The invention claimed is:

1. A flexible pipe connector fitting, comprising:

a cylindrically shaped main connection fitting having a first opening at a first end, a second opening at an opposite second end and a third opening intermediate said first and second openings;

a first flexible branch conduit having a first end adapted to being connected to a first flue pipe and a second end connected to the first opening at the first end of the cylindrically shaped main connection fitting;

a second flexible branch conduit having a first opening at a first end connected with the third opening in the cylindrically shaped main connection fitting;

a third flexible branch conduit having a first end connected to the second opening of the second end of said cylindrically shaped main connection fitting and a second end adapted to be connected to a second flue pipe;

an oblong shaped gutter attached at an oblique angle to an inner circumference of the cylindrically shaped main connection fitting, the oblong shaped gutter attached with a gutter surface mounted between the second opening of the cylindrically shaped main connection fitting and the first opening of the second flexible branch whereby the gutter surface extends upward from the second opening of the cylindrically shaped main connection fitting towards the first opening at the first end of the cylindrically shaped main connection fitting;

a damper mounted within the cylindrically shaped main connection fitting at the intersection of the second opening of the cylindrically shaped main connection fitting and the first opening of the second flexible branch for moving between a first position that opens the second end of the third flexible conduit and closes the first end of the second flexible conduit to provide communication between the first and third flexible conduits, a second position that opens the first end of the second flexible conduit and rests against the oblong shaped gutter surface to close the second end of the third flexible conduit and provide communication between the first and second flexible conduits whereby the damper channels debris from the first flexible conduit into the second flexible conduit; and a removable bin connected to a second end of the second conduit, the bin having an access inlet through which a flexible brush mounted to a brush rod can be inserted through the second flexible conduit and wherein when the damper is in the second position to provide communication between the first and second flexible conduits, the flexible brush mounted to the brush rod can be directed by the damper into the first conduit for cleaning the first conduit and debris from the first conduit is directed by the damper into the second conduit to be collected in the bin.

2. The flexible pipe connector fitting of claim 1, wherein the access inlet in the removable bin receives the flexible brush mounted to the brush rod, the brush rod being of a length sufficient to extend, when said damper is in the second position, through the connection intersection and into said first flexible branch conduit to a flue pipe.

3. The flexible pipe connector fitting of claim 1, wherein said second conduit has as second outlet end and said bin includes an access end for receiving the second outlet end of the second conduit.

4. The flexible pipe connector fitting of claim 3, wherein said bin is detachable from the second conduit and configured with an enclosure in which debris is collected and having the brush inlet through which the flexible brush mounted to the brush rod can be inserted when cleaning is desired and removed thereafter.

5. The flexible pipe connector fitting of claim 4, which includes a pivotable cover for removably covering the brush inlet.

6. The flexible pipe connector fitting of claim 1, wherein said damper has a third position between the first and second position to control the level of draft through the first and third conduits.

* * * * *